US006158854A

United States Patent [19]

Watts et al.

[11] Patent Number: 6,158,854

[45] Date of Patent: Dec. 12, 2000

[54] CONNECTION FOR REPLACEMENT FLUID CONTAINERS FOR INK JET PRINTERS

[75] Inventors: Stephen Watts, Northants; Nigel George Moore, Cambridgeshire, both of United Kingdom

[73] Assignee: Domino Printing Sciences PLC, United Kingdom

[21] Appl. No.: 09/208,221

[22] Filed: Dec. 9, 1998

[30] Foreign Application Priority Data

Jan. 9, 1998 [GB] United Kingdom ..... 9800496

[51] Int. Cl.[7] ..... B41J 2/175

[52] U.S. Cl. ..... 347/86; 347/85

[58] Field of Search ..... 347/84, 85, 86, 347/87; 285/27, 12; 141/384

[56] References Cited

U.S. PATENT DOCUMENTS

| | | | |
|---|---|---|---|
| 4,211,439 | 7/1980 | Moldestad | 285/27 |
| 4,665,960 | 5/1987 | Brzezicki et al. | 141/384 |
| 4,708,370 | 11/1987 | Todd | 285/12 |
| 5,920,333 | 7/1999 | Bates | 347/85 |

*Primary Examiner*—N. Le
*Assistant Examiner*—Anh T. W. Vo
*Attorney, Agent, or Firm*—Robert F. I. Conte; Lee Mann Smith McWilliams Sweeney & Ohlson

[57] ABSTRACT

A container (1) is proposed for replenishing ink or solvent in an ink jet printer ink system. The container (1) has a plug-in connector (7) for attachment to a mating connector on the ink system along an axis so that fluid within the container (1) can be transferred to the ink system. Adjacent to the connector (7) a cam surface is disposed so as to cause the connector (7) to disconnect from the mating connector on rotation of the container (1) in a direction about the axis.

8 Claims, 3 Drawing Sheets

CONNECTION FOR REPLACEMENT FLUID CONTAINERS FOR INK JET PRINTERS

FIELD OF THE INVENTION

The present invention relates to a replacement fluid container for connecting to the ink system of an ink jet printer.

BACKGROUND OF THE INVENTION

It is well known in the art of ink jet printing to attach replaceable containers of ink and solvent to ink systems of ink jet printers in order that fluid in the ink system can be topped up as required. Inks and solvents used in ink jet printing are frequently volatile and noxious, and it is therefore desirable to provide clean and safe ways by which they may be handled. It is also very important that the correct ink or solvent is used for a given application, and that this ink or solvent is not contaminated in any way. It is therefore an object of the invention to allow replacement ink and solvent containers to be attached and removed cleanly and simply, without spillage, to and from an ink jet printer, and it is also desirable to ensure that the ink and solvent are attached correctly to the ink jet printer.

It has previously been proposed to provide the containers with screw-threaded connections and also to fit the containers with snap-on rotatable rings having protrusions spaced appropriately to mate with recesses in cooperating member to which the container is intended for attachment, see WO-A-93/1890. Whilst such connections systems may operate satisfactorily, because the rings are snap fitted to the containers and provide the sole mechanism for preventing incorrect fitting (the containers otherwise being the same, it is possible for the wrong rings to be fitted and for the system to fail to prevent the wrong connections being made. Screw-threaded connections are also slow to operate.

BRIEF OF SUMMARY OF THE INVENTION

According to the present invention a container for replenishing ink or solvent in an ink jet printer ink system has a plug-in connector, for attachment to a mating connector on the ink system along an axis, through which fluid within the container can be transferred to the ink system and, adjacent the connector, a cam surface arranged to cause the connector to disconnect from the mating connector on rotation of the container in a first direction about the axis.

The invention also includes an adapter for enabling connection of such a container to an ink jet ink system, the adapter having a connector for mating with the corresponding plug-in connector of the container and through which fluid within the container can be transferred to the ink system, and a cam surface arranged to cause the container connector to disconnect from the adapter on rotation of the connector in the first direction.

Preferably, the cam surface on one of the container and the adapter is an annular helical cam surface disposed around the respective connector and the cam surface on the respective one of the adapter and container is a cam follower surface for engaging with the helical surface.

The adapter may also include a screw-threaded connection to a fluid reservoir of the ink system.

Preferably, when separate top-up ink and solvent containers are provided in the same system, the respective container and adapter connectors are designed to prevent attachment of the other container. This can readily be achieved when one of the cam surfaces is a helical cam surface by making the cam surfaces of opposite hands.

Preferably, both the cam surfaces have a large area of contact in order to reduce contact pressure. For the same reason, it is also desirable for there to be plural cam surfaces on each of the container and adapter.

It is also preferable that the cam surfaces are arranged such that rotation of 90 degrees in the first direction completely separates the connector and adapter.

BRIEF DESCRIPTION OF THE DRAWINGS

An example of the present invention will now be described with reference to the accompanying drawings, in which.

DETAILED DESCRIPTION OF THE INVENTION

Figure 1:
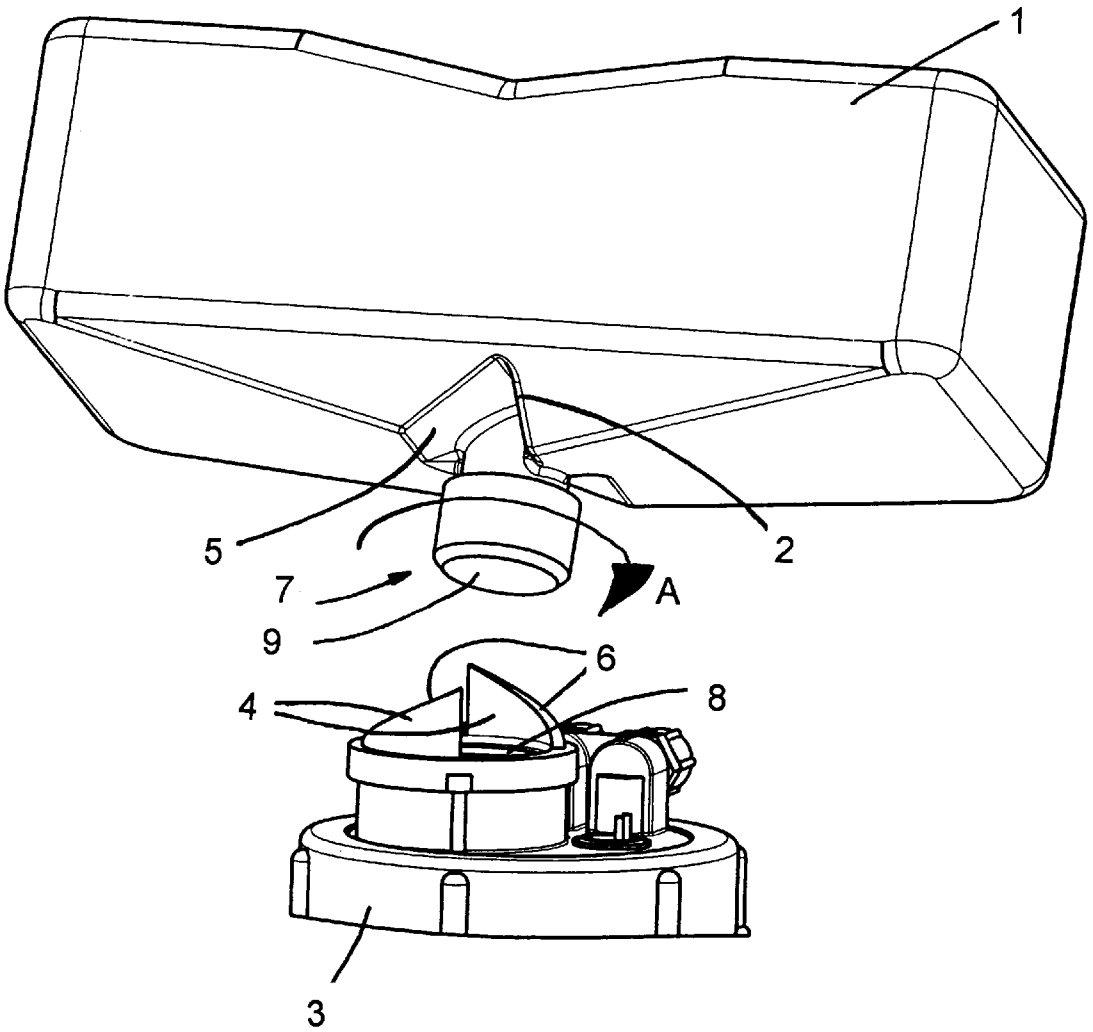
FIG. 1 is an illustration of a replacement ink container and an adapter for attachment to an ink system of an ink jet printer.
Figure 2:
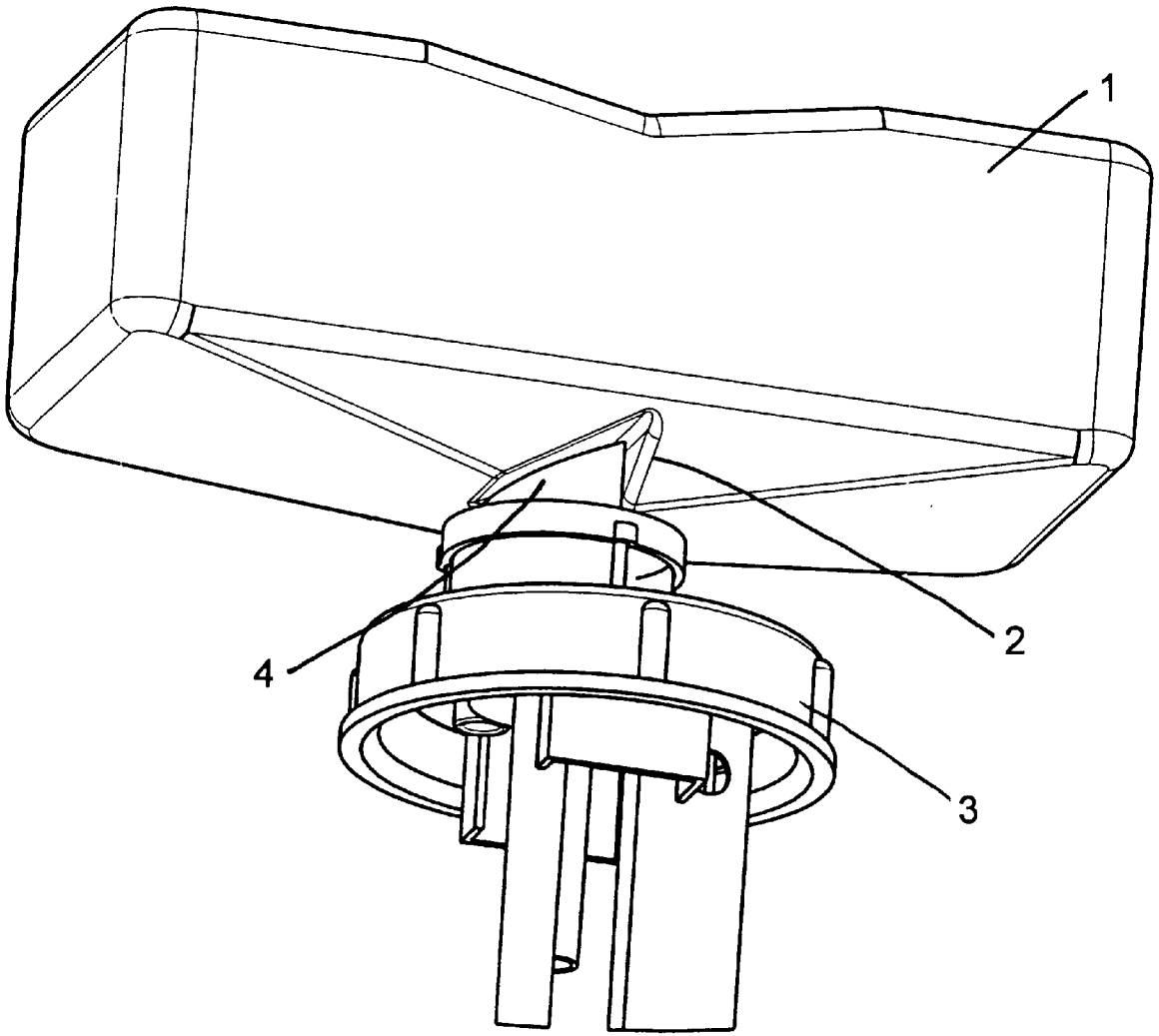
FIG. 2 is an illustration of a replacement ink container connected to an adapter for attachment to an ink system of an ink jet printer.

With reference to FIG. 1, a replacement ink or solvent container 1, for attachment to an ink jet printer ink system (see FIG. 3), has a connector 7 which has two recesses 2 formed around its periphery. The container 1 may be connected (as shown in FIG. 2) to an adapter 3, which is connected to an ink system of the ink jet printer. The adapter 3 is either an integral part of the ink jet printer or a separate, detachable, unit thereby enabling attachment to ports of the ink system of various ink jet printers to allow the containers to be fitted to a range of printers, in which case it may include a screw-threaded portion 3'. The adapter 3 has two protrusions 4 adapted to correspond with the recesses 2 of the ink container 1 when the container 1 and adapter 3 are fully connected. Between the protrusions 4, the adapter 3 has a receiving hole 8 adapted to receive a plug-in portion 9 of the connector 7. An 'O'-ring seal in the hole 8 ensures a sealed connection when the adapter 3 and connector 7 are fully connected.

The recesses 2 each have a cam follower surface 5 inclined to the centre axis of the connection and the protrusions 4 each have a corresponding angular helical cam surface 6 similarly inclined to the centre axis of the connection. When the container 1 is fully connected to the adapter 3 the surfaces 5 and 6 of each of the recesses 2 and 4 abut one another.

In use, the connector 7 is pushed, axially, into the adapter 3 to form a sealed connection between the container 1 and the ink system. The container's ink or solvent may then flow through the connection to top-up the fluid of the ink system on demand.

When empty, the container 1 may be removed from the adapter 3 by rotation in the direction of arrow A. This causes the surfaces 5 and 6 to slide over one another and, due to the incline of the surfaces 5 and 6, the protrusions 4 are displaced from the recesses 2 and the container 1 is smoothly urged away from the adapter 3, breaking the sealed connection between the plug-in portion 9 of the connector 7 and the hole 8 of the adapter 3.

An advantage of this arrangement is that, in comparison to pulling the container 1 from the port 3 to break the seal in a conventional manner, a rotating motion may be applied to the container in a restrained and a controlled manner, allowing less force to be used in removal and providing for clean and easy handling of containers 1.

Furthermore, the specific positioning and shape of the protrusions 4 and recesses 2 ensures attachment of only containers 1 specifically designed to be attached to the corresponding adapter 3 as the recesses 2 must fully accommodate the protrusions 4 for a connection to be formed. For example, if the hand of the inclined surfaces 5 and 6 about the axis of connection is clockwise for replacement solvent containers and adapters for solvent ports, and the hand is anticlockwise for replacement ink containers and adapters for ink ports, erroneous connection of solvent and ink containers may be prevented.

Figure 3:
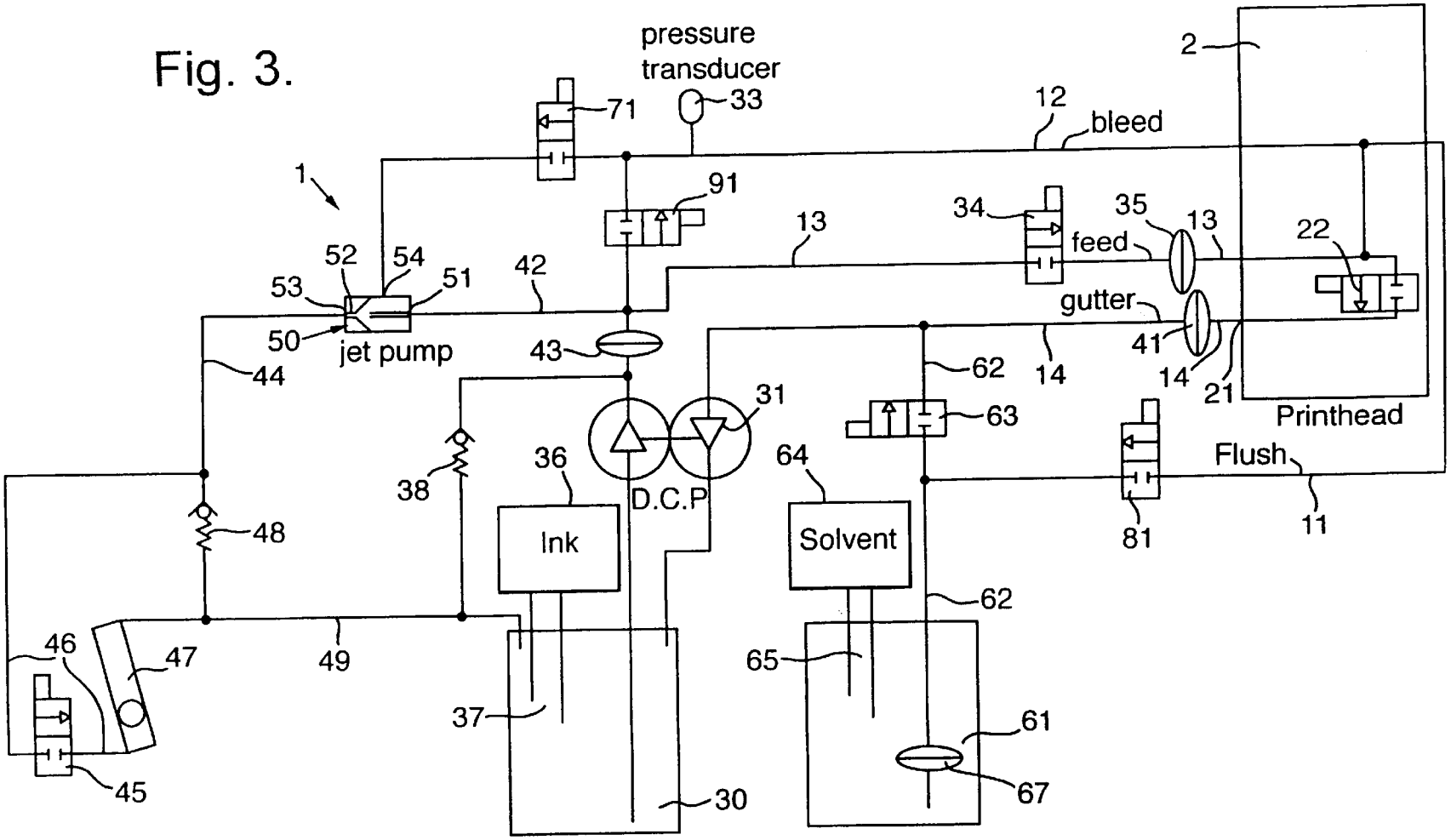
FIG. 3 is a circuit diagram of an ink system employing adapters and containers of the present invention.

The circuit described below in connection with FIG. 3 is identical to that described in our co-pending European Patent Application no. 98307089.7.

The printhead 20 of the printer has a nozzle 21 to which ink is fed from a feed line port 23 around the sides of the piezoelectric drive rod (not shown) which fits in the bore 24. The actuator (not shown) of a printhead valve 22 (solenoid-operated) slides in a second bore 25 to open and close the nozzle 21. A bleed line port 26 allows ink to be bled from the printhead.

The ink system 10 of the exemplified printer of the present invention includes flow lines 11–14 which are connected a to the printhead 20 to provide, respectively, a flush line, a bleed line, a feed line and a gutter line. The solenoid-operated valve 22 which controls the flow of ink, in use, from the feed line 13 to the nozzle 21.

In normal operation ink is withdrawn from an ink reservoir 30 by means of one side of a dual circuit pump 31 and is passed along the feed line 13. Along the feed line 13 is positioned a solenoid-operated feed valve 34. The bleed line 12 has a pressure transducer 33 associated with it to measure the pressure of ink at the printhead (the bleed line is a static line and there is thus no pressure drop between the printhead 20 and the transducer 33). The ink passes into the printhead through a filter 35 and thence through the valve 22 and the nozzle 21. Ink droplets which are not used for printing are directed to the gutter line 14 and pass through a filter 41 and then back through the other side of the dual circuit pump 31 to the reservoir 30.

A replaceable ink cartridge 1 (as described above) provides, via a dip tube system 37, for topping up of the reservoir 30. As well as passing ink into the feed line 13, the dual circuit pump 31 also supplies ink to a line 42, through a filter 43, to a jet pump 50. The flow line 42 is connected to the primary inlet 51 of the jet pump 50 which provides, through an orifice 52, a flow of primary or entraining ink to an outlet 53. The outlet 53 provides ink into a flow line 44 from which it is fed selectively on operation of a solenoid-operated valve 45, either through a flow line 46 to a viscometer 47 or else through a pressure release valve 48, to a return line 49 into the reservoir 30. A pressure relief valve 38 provides over-pressure protection against high pressure in the output from the pump 31.

For flushing purposes, the primary flow of ink through the jet pump 50 is used to entrain a flow of solvent which acts as a flushing fluid, the solvent being supplied through a secondary port 54 in the conventional manner of a jet pump. Solvent is supplied to the inlet 54 from a solvent reservoir 61 via the flush line 11 and a solenoid-operated solvent flush valve 81, into the printhead, through the bleed line 12, and a solenoid operated bleed valve 71. A renewable solvent cartridge 1' (of the type described above) maintains the level of solvent in the reservoir 61 via a dip tube system 65. In use, additional solvent is supplied as necessary depending upon the viscosity determined in the viscometer 47, by selective operation of the valve 63, the added solvent being mixed with the ink flow through the gutter line 14 and passed back to the reservoir 30.

The bleed line 12 joins to the jet pump 50 through a solenoid-operated bleed valve 71 which, in normal use remains closed. The solenoid-operated flush valve 81 connects the flush line 11 to the solvent reservoir 61 and is also closed during normal operation. A solenoid operated secondary flush valve 91 connects the outlet of the dual circuit pump 31 with the bleed line between the bleed valve 71 and the printhead 20. This again is normally closed during operation of the printer.

At shut-down of the printer, and as described above, solvent is flushed through the printhead to remove residual ink and this is achieved as follows. First, the printhead valve 22 is closed so that ink is no longer supplied to the nozzle 21. Ink continues to circulate from the reservoir 30 through the pump 31, via the jet pump 50 and the return line 49. The feed valve 34 is then closed and the flush valve 81 and bleed valve 71 are opened so that solvent from the reservoir 61 can be drawn, via a filter 67, under the negative pressure provided by the jet pump 50 in the bleed line 12, through the flush line 11, the printhead 20 and the bleed line 12. Once solvent has passed into the printhead 20 and into the bleed line 12 then the flush valve 81 and bleed valve 71 are closed. The secondary flush valve 91 is opened briefly to pressurise the printhead and then the printhead valve 22 is also opened so that ink supplied to the bleed line 12 through the secondary flush valve 91 pushes solvent in the bleed line through the printhead valve 22 and out through the nozzle 21. Thus, solvent is flushed through all the necessary parts of the printhead 20. The printer can then be shut down until required again.

The flush valve 81 and the printhead valve 22 may be pulsed open and closed during the flushing procedure in order to reduce the amount of solvent used.

The jet pump 50 acts to provide a source of negative pressure to draw solvent through the flush line 11 and into the bleed line 12, avoiding the need for a separate flushing pump and the arrangement also improves the cleaning of the gun body. Furthermore, the vacuum produced by the jet pump enables the gutter vacuum to be maintained during the flushing procedure which, in turn, eliminates the possibility of ink running out of the gutter as the printer is shut down.

Pressurising the secondary flush valve 91 produces a weaker dilution of ink and solvent to be passed through the nozzle, due to the fact that the bleed line is used to return the flushed fluid to the ink reservoir 30 during cleaning, thus improving the cleaning of the nozzle.

What is claimed is:

1. A container for replenishing ink or solvent in an ink jet printer ink system, the container having a plug-in connector defining an axis, for attachment to a mating connector on the ink system along said axis, through which fluid within the container is transferred to the ink system in use; and, adjacent the plug-in connector, a cam surface arranged to engage said mating connector in use, said cam surface is an annular helical cam surface disposed around said connector and adapted to cause the plug-in connector to disconnect from the mating connector on rotation of the container in a direction about said axis.

2. A container according to claim 1, wherein the cam surface is a cam follower surface.

3. An adapter for connecting a container to an ink jet printer ink system, said container having a plug-in connector defining an axis, said adapter having a mating connector on the ink system for attachment to said plugs-in connector along said axis and through which fluid within the container is transferred to the ink system in use; said mating connector has an annular helical cam surface, a cam surface adjacent the plug-in connector and arranged to engage said annular helical cam surface of aid mating connector in use and adapted to cause the plug-in connector to disconnect from the mating connector on rotation of the container in a direction about said axis.

4. The adapter of claim 3, further including a screw-threaded connector for connection of said adapter to a fluid reservoir of the ink system.

5. An adapter according to claim 3, wherein the cam surface is a cam follower surface.

6. An ink jet printer ink system having a container as defined in claim 1 and an adapter as defined in claim 3.

7. An ink jet printer ink system claim 6, having separate top-up ink and solvent containers and respective adapters for said top-up ink and solvent containers, wherein the respective container and adapter connectors are so constructed differently as to prevent attachment of a respective top-up ink container to a respective solvent adapter and vice versa.

8. An ink jet printer ink system according to claim 7, wherein the cam surfaces of the container adapter connectors are helical cam surfaces of opposite hands.

* * * * *